United States Patent [19]

Schweizer

[11] 4,439,643

[45] Mar. 27, 1984

[54] SYSTEM ASSEMBLY FOR MOUNTING ELECTRICAL APPARATUS ON WALLS AND CEILINGS

[76] Inventor: René Schweizer, Seestrasse 121, 8800 Thalwil, Switzerland

[21] Appl. No.: 26,286

[22] Filed: Apr. 2, 1979

[51] Int. Cl.[3] ..... H04R 1/00

[52] U.S. Cl. ..... 179/146 E; 179/146 R; 181/153

[58] Field of Search ..... 179/146 E, 146 R, 1 E; 181/148, 150, 153, 189, 190, 199; 285/DIG. 22; 220/306, 307; 368/284, 312, 316

[56] References Cited

U.S. PATENT DOCUMENTS

| | | | |
|---|---|---|---|
| 1,661,674 | 3/1928 | Osborn | 285/DIG. 22 |
| 2,115,098 | 4/1938 | Engholm | 179/146 E |
| 2,141,423 | 12/1938 | Tolerton | 179/146 E |
| 3,443,660 | 5/1969 | Virva et al. | 181/153 |
| 4,072,829 | 2/1978 | Ogihara | 179/146 R |
| 4,123,621 | 10/1978 | Walker | 181/153 |
| 4,152,544 | 5/1979 | Sanpei et al. | 179/146 R |
| 4,179,009 | 12/1979 | Birkner | 181/150 |

*Primary Examiner*—Gerald L. Brigance

*Attorney, Agent, or Firm*—Rogers, Eilers & Howell

[57] ABSTRACT

A system of mounting electrical equipment, such as loud speakers, electrical clocks, radios and the like, in an enclosure which has a grill with flanges which telescope with complementary flanges on a mounting plate. The mounting plate may be secured to walls or ceilings by flush mounting or edge mounting brackets and may be secured in either a horizontal or vertical position. If an edge mounting bracket is used, the mounting plate is a plural center ring which receives telescoping cover plates from both sides to form a clamshell enclosure. Where flush mounting is used, such as on walls or ceilings, a single telescoping ring is used, which is mounted in the wall or ceiling, and the grill work and the complementary telescoping ring is attached thereto.

9 Claims, 16 Drawing Figures

FIG. 8
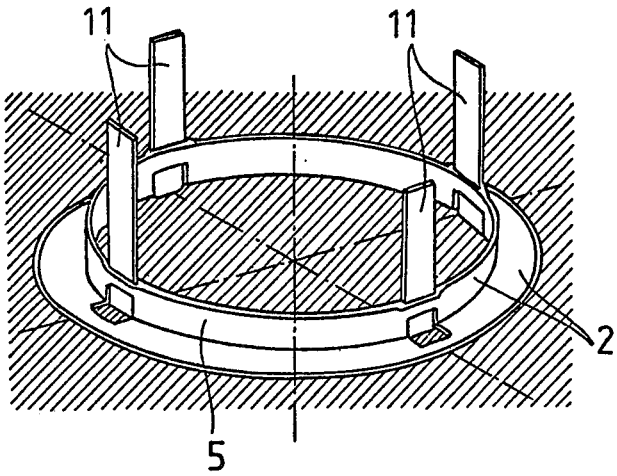
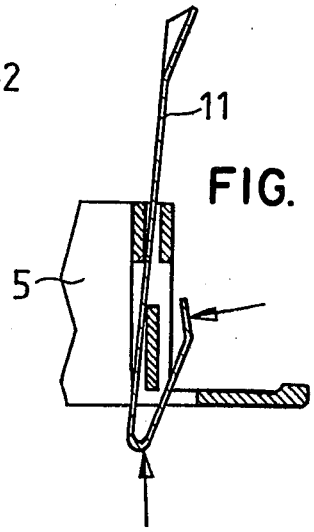
FIG. 10
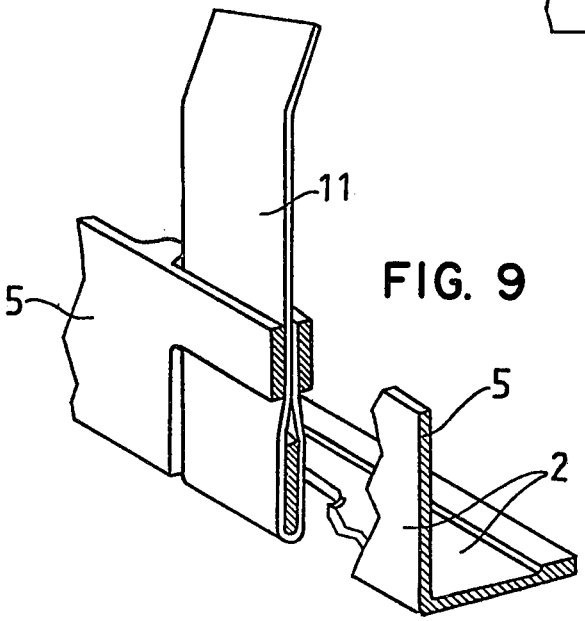
FIG. 9

SYSTEM ASSEMBLY FOR MOUNTING ELECTRICAL APPARATUS ON WALLS AND CEILINGS

BACKGROUND AND SUMMARY OF THE INVENTION

The present invention relates to grill work and enclosures for electrical and electronic devices such as loud speakers, clocks, radios and the like, particularly those which are found in public places and are commonly mounted on the walls or ceilings of such places. The enclosures typically take the form of grill works or baffle structures within which or on which a device such as a clock or loud speaker is mounted. The present invention relates to such a system or assembly which is technically simple in construction, of modern pleasing design, is of high quality and durability and is convenient in the ways of mounting.

The system normally includes a base plate or grill, a mounting plate, the electronic or electrical apparatus which is mounted, and a front grill. The base plate normally is detachable and, in some cases, may be identical to the front grill. The base plate and grill are connected to the mounting plate by push-fit rings or snap rings which may snap into one another and may have integral spring locking clips. The base plate and grill can be detached from one another. The mounting plate may be a plate with a push-fit or snap fit ring on both sides, or only on one side. The snap-fit ring on the base plate, if used, snaps into one side and the snap-fit ring on the front grill snaps into the other side. The rings on the mounting plate or on the grill may also have spring clips which secure the electronic or electrical apparatus in place when the snap rings on the base plate and/or grill are snapped into those on the mounting plate.

The mounting plate can be mounted on the ceiling or walls with screws, nails, flexible mounting clips or it can be mounted to walls or ceilings by means of a mounting bracket. It will be appreciated that where a ceiling mounted device such as a loud speaker is used, it is not necessary to use an identical base plate and front grill, but rather the mounting plate may be fixed to the ceiling, either a single or a double sided snap ring assembly, and the grill work can be attached to the front of that.

DESCRIPTION OF THE DRAWINGS

FIG. 1 shows the base plate,

FIG. 2 shows the mounting plate,

FIG. 3 shows a loudspeaker and

FIG. 4 shows the front grill as sound diffuser.

FIG. 8 Diagram of mounting plate with mounting clips for securing in an aperture in the ceiling, FIGS. 9 and 10 Diagram showing details of FIG. 8

DESCRIPTION OF THE PREFERRED EMBODIMENTS

Figures 1, 2, 3, 4:
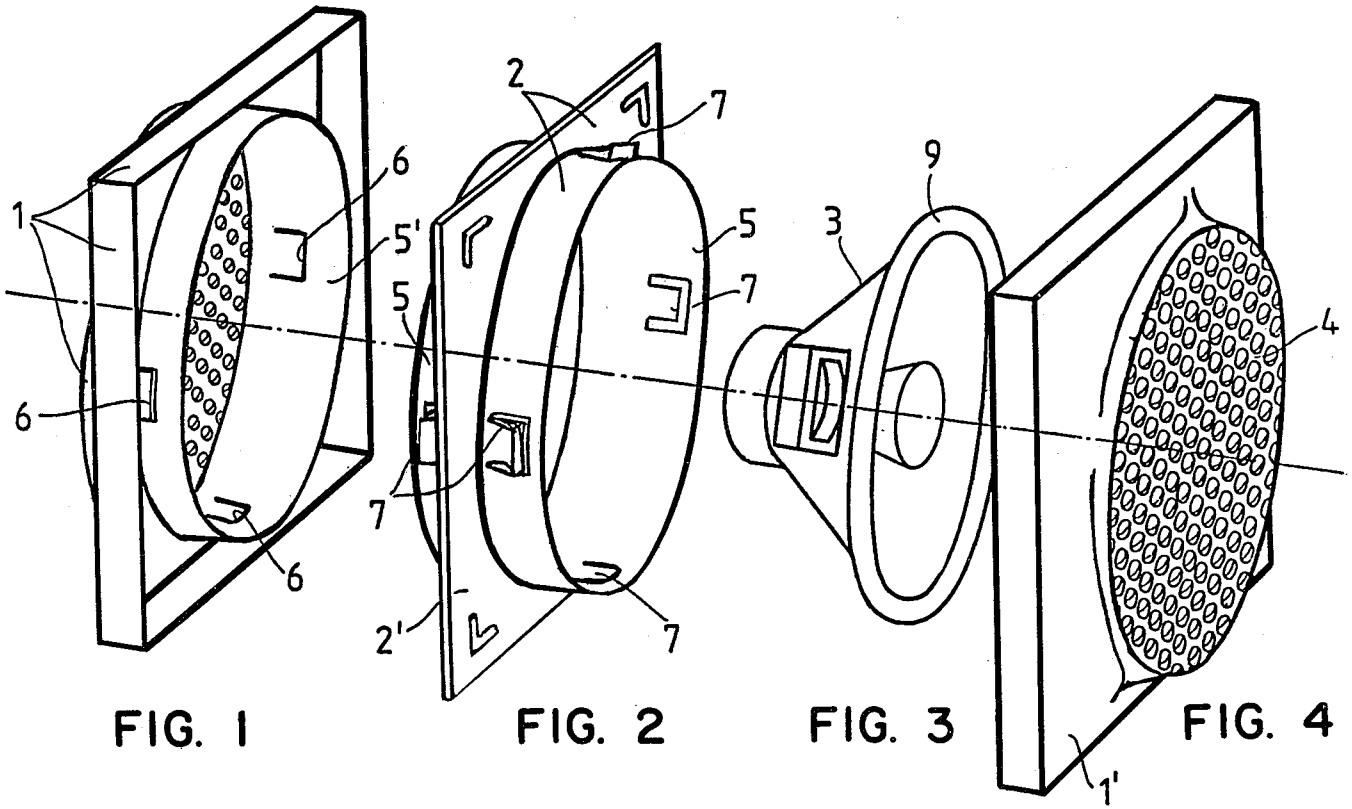
FIG.1 to FIG. 4 the component parts of a loudspeaker assembly.

As shown in FIGS. 1–4, the system assembly has a base plate 1, a mounting plate 2, electrical apparatus 3 and a front grill 4 with appropriate front plate. The mounting plate 2 forms a square plate 2', which has push-fit rings 5 protruding from both sides.

Figure 5:
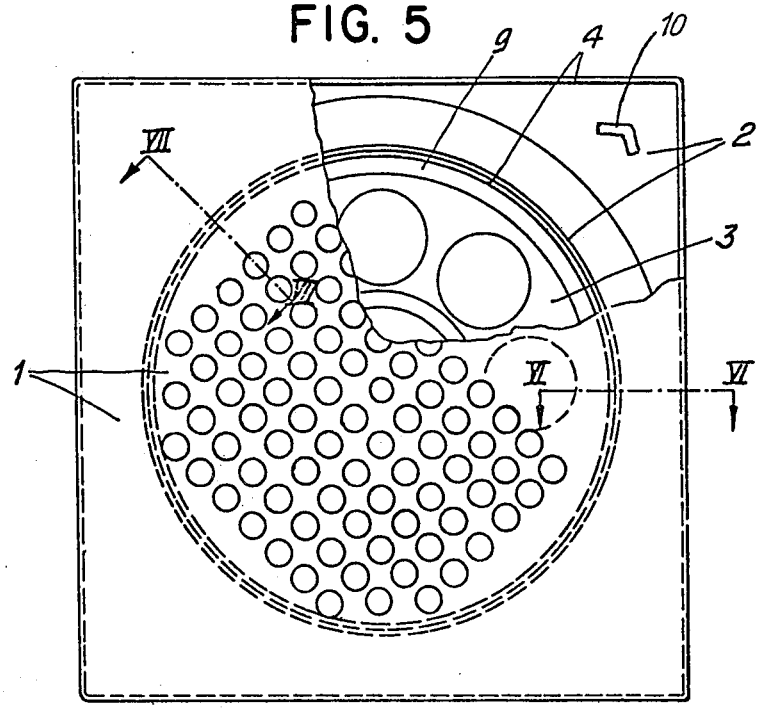
FIG. 5 View of system assembly, partial view of front grill.
Figure 7:
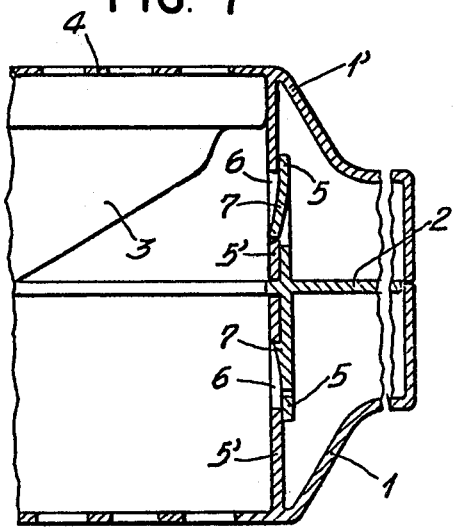
FIG. 7 Partial section of Line VII—VII, FIG. 5.
Figure 6:
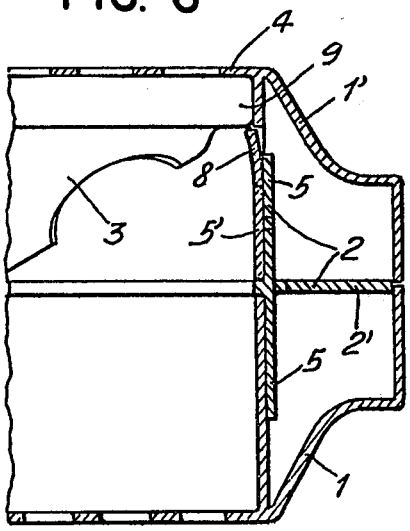
FIG. 6 Partial section of Line VI—VI, FIG. 5, on a larger scale.

The base plate 1 and the front plate 1' of the front grill 4 also have push-fit rings 5' on their reverse sides, which click into the push-fit rings 5 on the mounting plate 2. The push-fit rings 5' on the base plate 1 and the front plate 1' have slots 6, as seen in FIG. 7, which the clips 7 on the push-fit rings 5 on the mounting plate click into. The push-fit rings 5' on the front plate 1' have springy clips 8 which, as seen in FIG. 6, engage over the rim 9 of the apparatus 3 and hold it in place. FIG. 5 shows the square plate 2' of the mounting plate 2 with holes 10 at the corners for screwing the mounting plate 2 on to the ceiling or wall.

Figure 11:
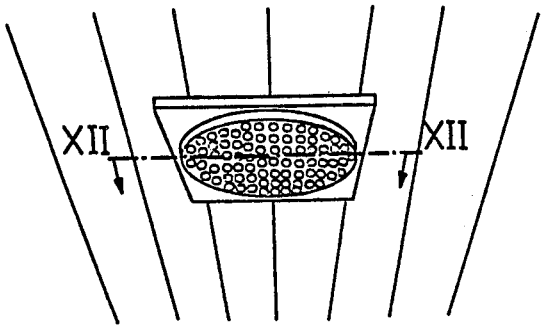
FIG. 11 Diagram of the system assembly mounted in an aperture in the ceiling.

FIGS. 8 to 10 show the mounting plate 2 with its flexible mounting clips, which make it possible to insert and secure the mounting plate 2 in a hole 12' in the ceiling or wall (see FIGS. 11 and 12) by bending over the mounting clips. The mounting plate 2 can also be screwed on to the ceiling or wall through the holes at its corners.

FIGS. 13–16 show various ways of mounting the system assembly, in this case with the loudspeaker installation.

Figure 12:
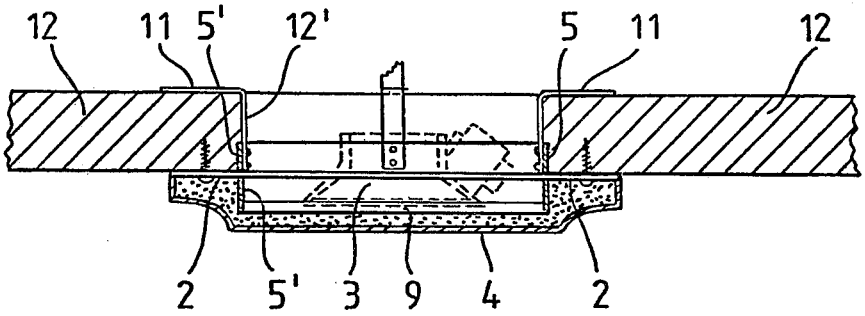
FIG. 12 Vertical cross-section of Line XII—XII, FIG. 11.
Figure 13:
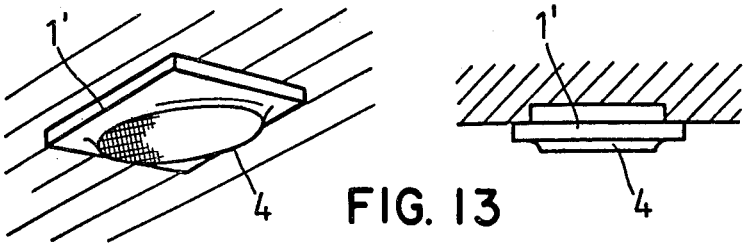
FIG. 13 Diagram and semiplan view of system assembly built into ceiling.
Figure 14:
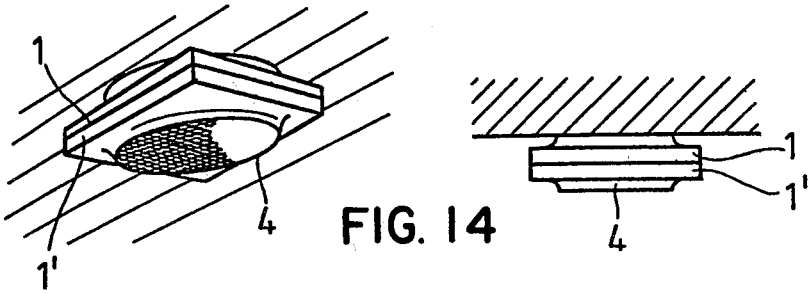
FIG. 14 Diagram and semiplan view of system assembly built into ceiling.
Figure 15:
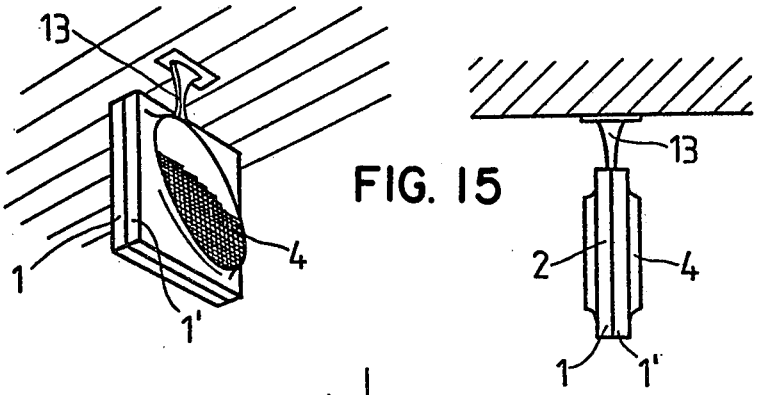
FIG. 15 Diagram and semiplan view of system assembly supended from ceiling.
Figure 16:
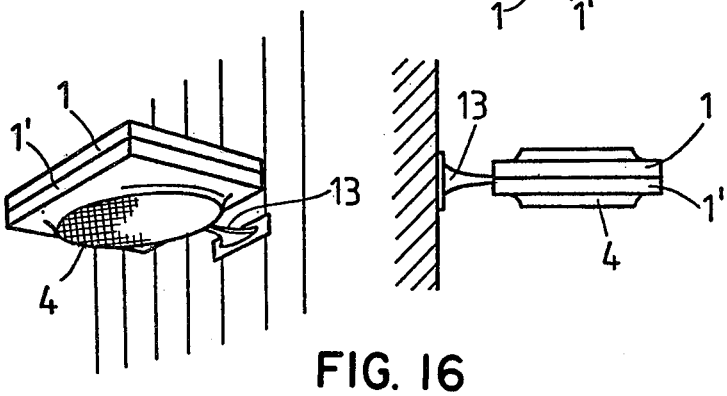
FIG. 16 Diagram and semiplan view of wall bracket version of system assembly.

FIGS. 12 and 13 show the mounting plate 2 screwed on to the ceiling by means of screws or the metal mounting clips 11; the push-fit ring 5 grips in the opening 12' or the ceiling 12'. The front grill's 4 push-fit ring 5' holding the loudspeaker or other electrical apparatus 3 is clicked into push-fit ring 5 on the mounting plate 2, which grips in the hole 12' in the ceiling 12 and is either screwed down or secured by the metal mounting clips.

The invention submitted herewith relates to a system assembly which has the following special features: technical simplicity, modern design, high quality apparatus and many ways of mounting it.

This system assembly comprises a base plate, a mounting plate, electrical apparatus and a front grill. The detachable base plate and identical front grill are connected to the mounting plate by push-fit rings clicked into one another with springy locking clips.

The base plate and front grill can be detached from one another. The mounting plate is a plate with push-fit rings on both sides, which the push-fit ring on the base plate clicks into on one side and the push-fit ring on the front grill clicks into on the other side.

The push-fit rings on the mounting plate have springy clips which secure the electrical apparatus in place when the push-fit rings on the base and front plates are clicked into those on the mounting plate.

The mounting plate can be mounted on the ceiling or wall with screws, nails or flexible metal mounting clips.

I claim:

1. A system assembly for mounting electrical apparatus such as loud speakers on ceilings and walls, comprising a base plate, a mounting plate, electricl apparatus, and a front grill; the base plate, and the front grill being connected to the mounting plate by push-fit rings with springy locking clip means, the locking clip means being on the base plate and the front grill and being complementary to second locking clip means on the mounting plate, the locking clip means of the mounting plate, the base plate and the front grill cooperating to form an enclosure and to hold the assembly about an electrical apparatus contained therein.

2. The assembly of claim 1 wherein the assembly has means to hold the electrical apparatus firmly within the assembly.

3. The assembly of claim 2 wherein the holding means is a set of projections on the grill extending into the enclosure formed by the assembly.

4. The assembly of claim 3 wherein the projections are adapted to engage over a rim of the electrical apparatus contained in the enclosure.

5. The assembly of claim 1 wherein the assembly has additional mounting means.

6. A system assembly for mounting apparatus, such as loud speakers, within the assembly; comprising: a mounting plate adapted to be secured to a wall or the like support, the plate having a central opening therethrough for receiving the apparatus therein; a flange ring attached to the mounting plate about the central opening, a second plate having a flange ring complementary to the flange ring on the mounting plate and adapted to be telescoped with the same, and snap means for securing the ring together into an enclosure when so telescoped.

7. In the system of claim 6, the flange ring of the mounting plate extending from both faces of the mounting plate and forming a first flange ring and a second flange ring, the system assembly including a third plate having a complementary flange ring also telescopable into the second flange ring on the mounting plate, and snap means for securing them together as part of the enclosure when so telescoped.

8. In the system of claim 6, the telescoping ring on the second plate having projections extending inwardly and engageable with the rim of an electrical apparatus, such as a loud speaker, to hold it onto the second plate when placed therein.

9. The system assembly of claim 6 wherein the assembly, when joined together, forms an enclosure for a loud speaker, and wherein the second plate and a third plate are complementary halves of the enclosure, each half being substantially identical, the mounting plate having means to join the halves into an enclosure in a clamshell manner about a loud speaker contained therein, the joining means including first and second flange rings on the mounting plate, the second and third plates having cooperating flange rings telescopable with the flange rings on the mounting plate, the flange rings on the second and third plates having openings therethrough and spaced about the circumferences of the flange rings of the second and third plates, the flange rings on the mounting plate having resilient tabs thereon and formed integrally therewith, the tabs on the mounting plate flange rings being spaced about the circumferences of the mounting plate flange rings and being complementary to the openings in the second and third plate mounting rings and being engageable therein to hold the second and third plates on the mounting ring in a clamshell assembly, at least one of the second and third plates having a second resilient tab means on its associated flange ring and formed integrally therewith, the second tab means being spaced about the circumference and extending into the interior of the associated flange ring, the second tab means being resiliently engageable with a loud speaker placed in the associated flange ring to hold the loud speaker secure within the enclosure formed by the joined assembly, the assembly having additional means to mount the joined assembly to a supporting structure.

* * * * *